US010302267B2

(12) United States Patent
Dellock et al.

(10) Patent No.: US 10,302,267 B2
(45) Date of Patent: May 28, 2019

(54) COLOR INFUSED AUTOMOBILE HEADLAMP LENS

(71) Applicant: Ford Global Technologies, LLC, Dearborn, MI (US)

(72) Inventors: Paul Kenneth Dellock, Northville, MI (US); Stuart C. Salter, White Lake, MI (US); Talat Karmo, Waterford, MI (US); John Matthew Teodecki, Grosse Pointe Park, MI (US); Arsen Terjimanian, Troy, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 648 days.

(21) Appl. No.: 14/524,030

(22) Filed: Oct. 27, 2014

(65) Prior Publication Data

US 2016/0116130 A1 Apr. 28, 2016

(51) Int. Cl.

| | |
|---|---|
| ***F21S 41/20*** | (2018.01) |
| ***F21S 41/32*** | (2018.01) |
| ***F21S 41/143*** | (2018.01) |
| ***F21S 41/275*** | (2018.01) |

(52) U.S. Cl.

CPC ..... *F21S 41/143* (2018.01); *F21S 41/275* (2018.01); *F21S 41/285* (2018.01); *F21S 41/321* (2018.01)

(58) Field of Classification Search

CPC ..... F21S 48/1283; F21S 48/1154; F21S 48/1225; F21S 48/1323

USPC ..... 427/162–169

See application file for complete search history.

(56) References Cited

U.S. PATENT DOCUMENTS

| | | | | |
|---|---|---|---|---|
| 5,130,904 | A | 7/1992 | Ohshio et al. | |
| 6,210,028 | B1 | 4/2001 | Murakoshi et al. | |
| 8,425,065 | B2 | 4/2013 | Ravillisetty et al. | |
| 2003/0182738 | A1 | 10/2003 | Pyles et al. | |
| 2003/0189838 | A1* | 10/2003 | Schottland | F21V 3/04 362/509 |
| 2004/0221403 | A1 | 11/2004 | Pyles et al. | |

(Continued)

FOREIGN PATENT DOCUMENTS

| | | | |
|---|---|---|---|
| CA | 2410254 | A1 | 5/2003 |
| CN | 101566298 | A | 10/2009 |

(Continued)

OTHER PUBLICATIONS

China National Intellectual Property Administration, Notification of the First Office Action, Application No. 20151070239.4, dated Jan. 28, 2019 (16 pages).

*Primary Examiner* — Michael P Wieczorek
*Assistant Examiner* — Michael G Miller
(74) *Attorney, Agent, or Firm* — Vichit Chea; Price Heneveld LLP

(57) ABSTRACT

A method of forming a headlamp assembly includes molding a one-piece lens from a substantially clear polymer material having a slightly yellow tint. A blue dye is infused into an outer surface of the lens to a maximum depth of about 6-10 microns such that the outer surface has a blue appearance. A core of the lens is substantially clear or slightly yellow. UV stabilizers may also be infused into an outer surface portion of the polymer material. The lens and an LED light source may be positioned inside a housing have a clear side wall. The blue dye alters the appearance of the lens without significantly reducing the light-transmitting properties of the lens.

13 Claims, 7 Drawing Sheets

(56) References Cited

U.S. PATENT DOCUMENTS

| | | | | |
|---|---|---|---|---|
| 2005/0125916 | A1 | 6/2005 | Pyles et al. | |
| 2005/0127570 | A1 | 6/2005 | Pyles et al. | |
| 2009/0257240 | A1* | 10/2009 | Koike | F21S 48/1159 362/538 |
| 2010/0076172 | A1* | 3/2010 | Tanabe | B29D 11/00009 528/370 |
| 2010/0308488 | A1* | 12/2010 | Hyodo | B29C 45/14688 264/78 |
| 2014/0192547 | A1 | 7/2014 | Kumar et al. | |

FOREIGN PATENT DOCUMENTS

| | | | | |
|---|---|---|---|---|
| CN | 102959012 | A | 3/2013 | |
| CN | 203586031 | | 5/2014 | |
| JP | 2013195702 | A | 9/2013 | |
| JP | 2014071958 | A | 4/2014 | |
| WO | 9306160 | A1 | 4/1993 | |
| WO | WO 9306160 | A1 * | 4/1993 | B29D 11/00903 |
| WO | 03083207 | A1 | 10/2003 | |
| WO | 2004101881 | A1 | 11/2004 | |
| WO | 2005061597 | A2 | 7/2005 | |
| WO | 2005061780 | A1 | 7/2005 | |

* cited by examiner

COLOR INFUSED AUTOMOBILE HEADLAMP LENS

FIELD OF THE INVENTION

The present invention generally relates to headlamps for vehicles, and more particularly to a polymer lens that is infused with a colored dye to change the appearance of the lens.

BACKGROUND OF THE INVENTION

Various types of headlamps for motor vehicles have been developed. For example, LED headlamps may include an LED light source that directs light into a relatively thick lens to magnify and/or collimate light in a beam. When the headlamp is installed on a vehicle, a relatively thin light-transmitting cover may extend over the lens to protect the lens. The lens may be mounted inside a housing that is formed, at least in part, by the light-transmitting cover.

SUMMARY OF THE INVENTION

One aspect of the present invention is a method of forming a color infused optical headlight projector lens. The method includes providing a polymer headlamp lens comprising a substantially transparent polymer material having an appearance that is at least slightly yellow. The lens has an outer surface including an input surface portion that is configured to receive light from an LED light source, and an exit surface portion. The lens is configured to distribute light from an LED light source to form a collimated light pattern such that the lens is suitable for use in a vehicle headlight assembly. The method further includes infusing a dye into at least a portion of the outer surface of the headlamp lens to a maximum depth of about 6-10 microns. The dye alters the appearance of at least a portion of the outer surface such that at least a portion of the outer surface has a substantially clear or at least slightly blue appearance.

Another aspect of the present invention is a method of forming a headlamp assembly. The method includes molding a one-piece collimating lens from a clear polymer material. A blue dye is infused into an outer surface of the lens to a maximum depth of about 6-10 microns such that the outer surface appears blue, and a core of the lens remains substantially clear. The method further includes positioning the lens and an LED inside a housing having a clear side wall.

Another aspect of the present invention is a color infused headlight lens for vehicles including a polymer body having a core portion in an outer skin portion. The core portion comprises a substantially clear polymer material. The polymer body has an outer surface including an input portion that is configured to receive light from an LED light source and an exit portion. At least one colored dye is infused into the outer skin portion of the polymer body such that the outer skin portion of the polymer body is colored.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 1:
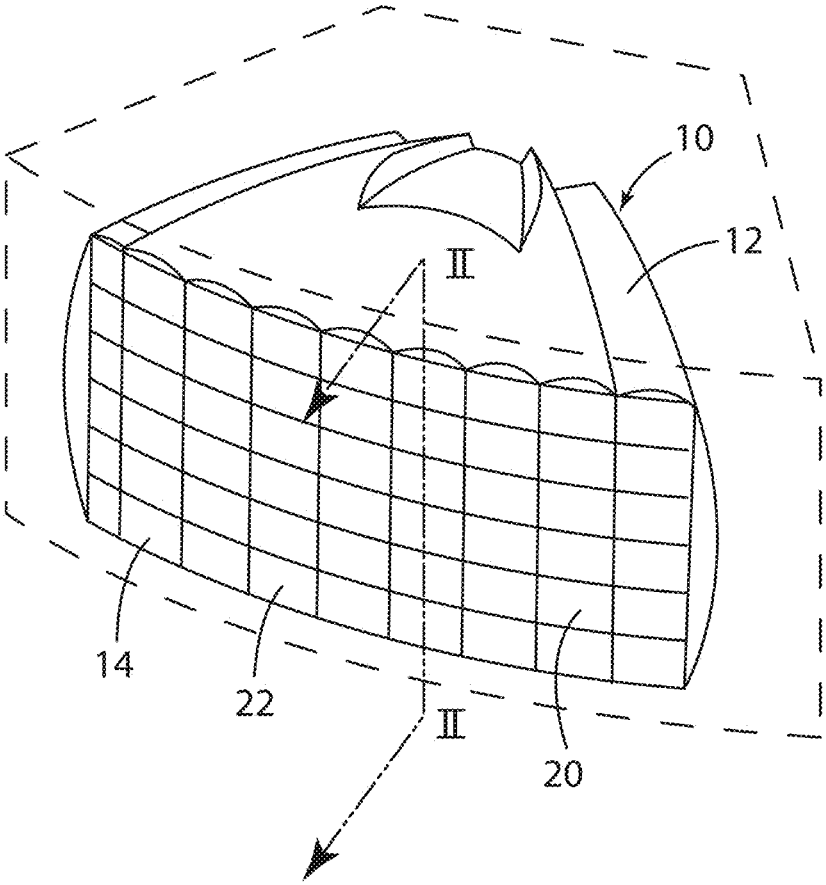
FIG. 1 is an isometric view of a color-infused lens according to one aspect of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
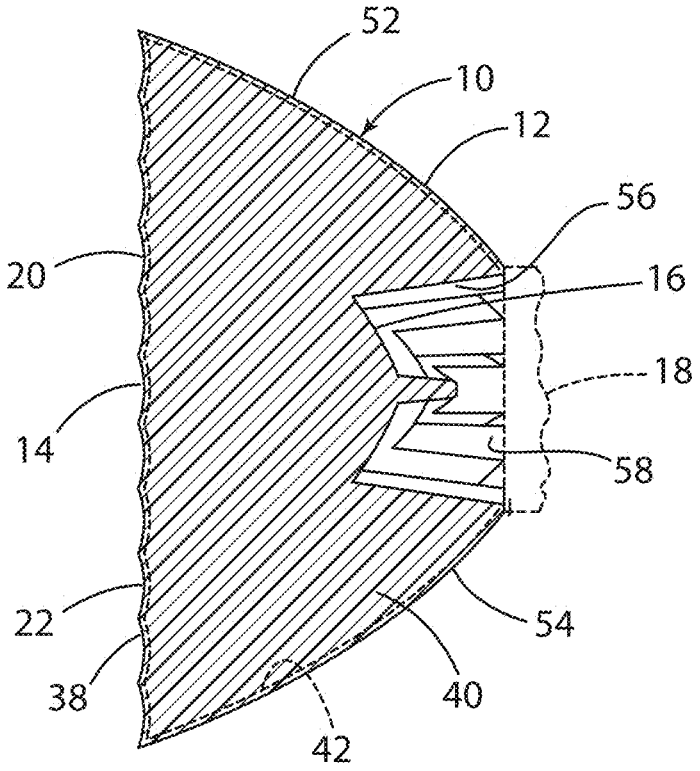
FIG. 2 is a cross sectional view of the lens of FIG. 1 taken along the line II-II.

With reference to FIGS. 1 and 2, a lens according to one aspect of the present invention includes a polymer body 12 that is molded from optically clear polycarbonate or other suitable polymer material that is substantially clear or transparent. In general, the natural color of "clear" polycarbonate and other such material is yellow or slightly yellow. Also, aging (e.g. exposure to sunlight) of the polymer and/or the addition of UV absorbers or stabilizers may also result in a yellow tint. In vehicle headlamp lenses, the yellow tint results in an appearance that is typically undesirable to vehicle owners and/or other observers. As discussed in more detail below, one aspect of the present invention is a method of infusing a dye and/or UV light stabilizers into an outer surface 14 of the polymer body 12 to thereby change the appearance of the lens 10 to reduce or eliminate the yellow appearance. In contrast to coating processes which deposit a separate layer of material onto a substrate, the infusion process results in dye and/or UV light stabilizers penetrating into an outer portion of the polymer substrate.

The polymer body 12 of lens 10 may include an outer surface 14 having a cavity 58 including an input (rear) surface portion 16 (FIG. 2) that is configured to receive light 34A from an LED light source 18, and an exit (front) surface portion 20 from which light escapes after being transmitted through the polymer body 12. The shape and construction of lens 10 may be substantially the same as the lens disclosed in U.S. Pat. No. 9,156,394, issued on Oct. 13, 2015 (U.S. Patent Publication No. 2014/0192547), the entire contents of which are incorporated herein by reference. Optical elements 22 of exit surface portion 20 are configured to shape a collimated light pattern into a beam such that the lens 10 is suitable for use in a headlamp assembly of a motor vehicle. It will be understood that the shape, size, and other aspects of lens 10 may vary depending on the requirements of a particular application.

Figure 3:
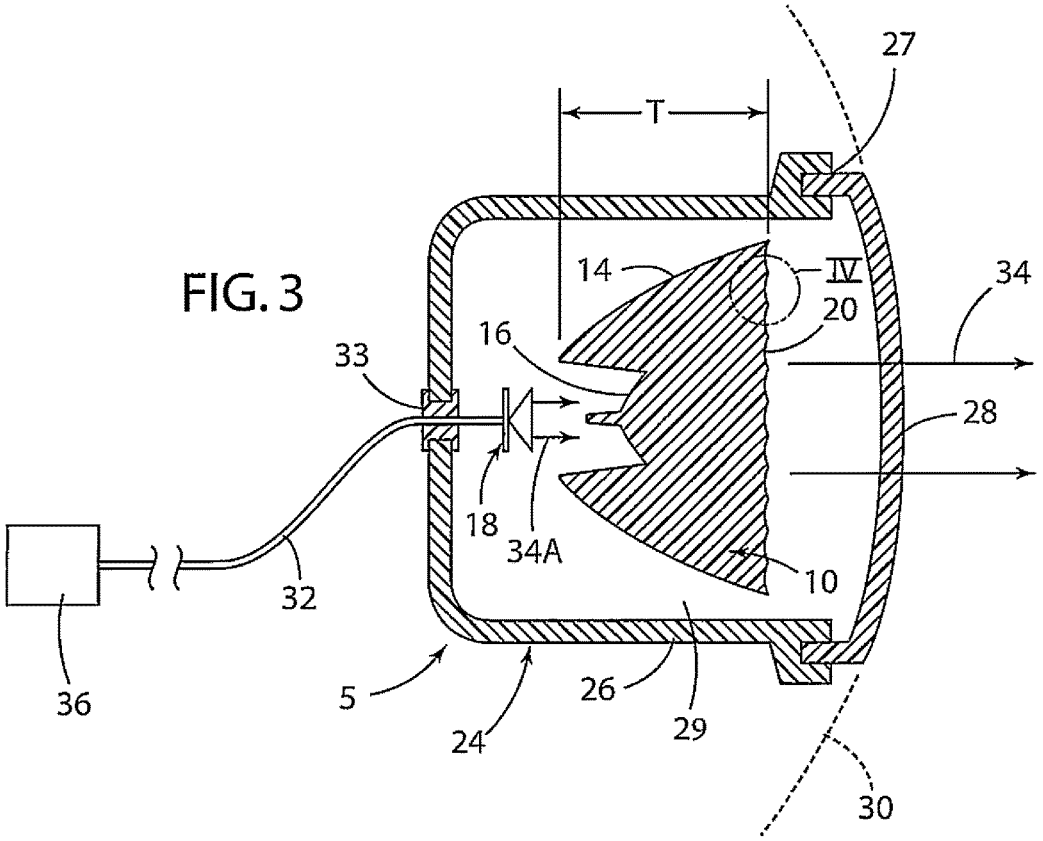
FIG. 3 is a partially schematic view of a headlamp assembly according to one aspect of the present invention.

As shown schematically in FIG. 3, lens 10 an LED light source 18 may be mounted in a watertight interior space 29 of a housing 24 having a rear portion 26 and a front cover 28. The rear portion 26 of the housing 28 may be opaque, and the front cover 28 may comprise a light-transmitting polymer that is substantially clear whereby light 34 escaping from exit surface portion 20 is transmitted through the front cover 28. LED light source 18 is connected to an electrical power supply 36 of a vehicle by a conductor such as an electrical line 32. Electrical circuit components (not shown) of a type known to those skilled in the art may be utilized to provide the required electrical power to LED 18 light source. Also, it will be understood that Led light source 18 may comprise a plurality of LEDs or a single LED as required for a particular application. A waterproof fitting 33 may be utilized to seal the electrical line 32, and joint 27 between rear housing portion 26 and front cover 28 may also be watertight to form watertight interior space 29. As disclosed in U.S. patent application Ser. No. 13/736,265, a plurality of lenses 10 may be positioned inside a single housing 24.

Figure 4:
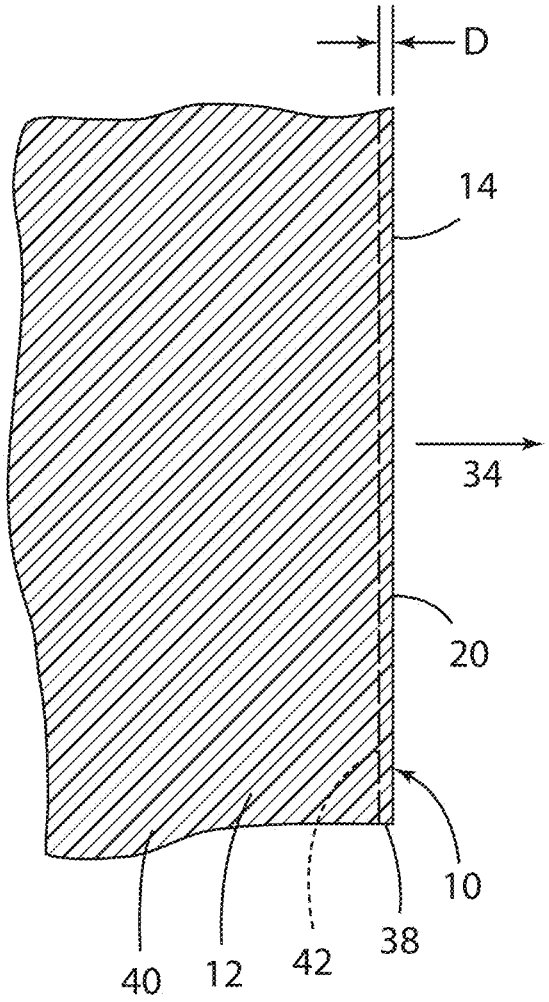
FIG. 4 is a fragmentary cross sectional view of a portion of the lens of FIG. 3.

With further reference to FIG. 4, at least a portion of outer surface 14 of polymer body 12 of lens 10 is infused with a colored dye and/or UV light stabilizer to a depth "D" as shown by the dashed line 42. The maximum depth "D" of penetration of the dye is preferably in the range of about 6-10 microns deep. The dye may be blue to thereby change the appearance of the outer surface 14 of lens 10 from a yellow or slightly yellow appearance to a clear or slightly bluish appearance. The outer portion or skin 38 of polymer body 12 is infused with the dye and/or UV stabilizer, and the skin 28 therefore has a color that is the same or similar to the color of the dye. The core or central portion 40 of polymer body 12 inside/below dashed line 42 is not infused with the dye, and the core 40 is therefore transparent/clear or slightly yellow depending upon the characteristics of the nominally clear polymer material (e.g. polycarbonate) utilized to mold the polymer body 12 to form the lens 10. It will be understood that the concentration of the dye and/or UV stabilizer in the outer portion or skin 38 of polymer body 12 may be at least somewhat non-uniform. In particular, the concentration of the dye directly adjacent outer surface 14 may be greater than the concentration of the dye immediately adjacent the dashed line 42 representing the greatest depth to which the dye is infused. In addition to a colored dye, a UV light stabilizer may also be infused into the outer surface 14, and the UV stabilizer may also penetrate to a depth "D." The dye and UV light stabilizers harden the polymer material of skin 38 to improve the wear resistance of outer surface 14.

Referring again to FIG. 3, lens 20 has an overall depth or thickness "T." The dimension "T" may be in the range of 2-3 inches or more as required for a particular application to provide for the required distribution of light 34 for use in a vehicle headlamp assembly 5. Because the dye and/or UV stabilizer is infused into a relatively thin skin 38 (FIG. 4), the dye has a relatively minor effect on absorption of light 34 relative to a lens wherein the entire polymer body 12 is colored by a dye. For example, in lenses (not shown) wherein the polymer body 12 has a dye uniformly mixed ("compounded") throughout the entire polymer body (i.e. including the core/central portion), 25% or more of the energy from the LED light source may be absorbed by the polymer body. This absorption generates heat and reduces the light intensity of the beam of light exiting the lens.

Figure 5:
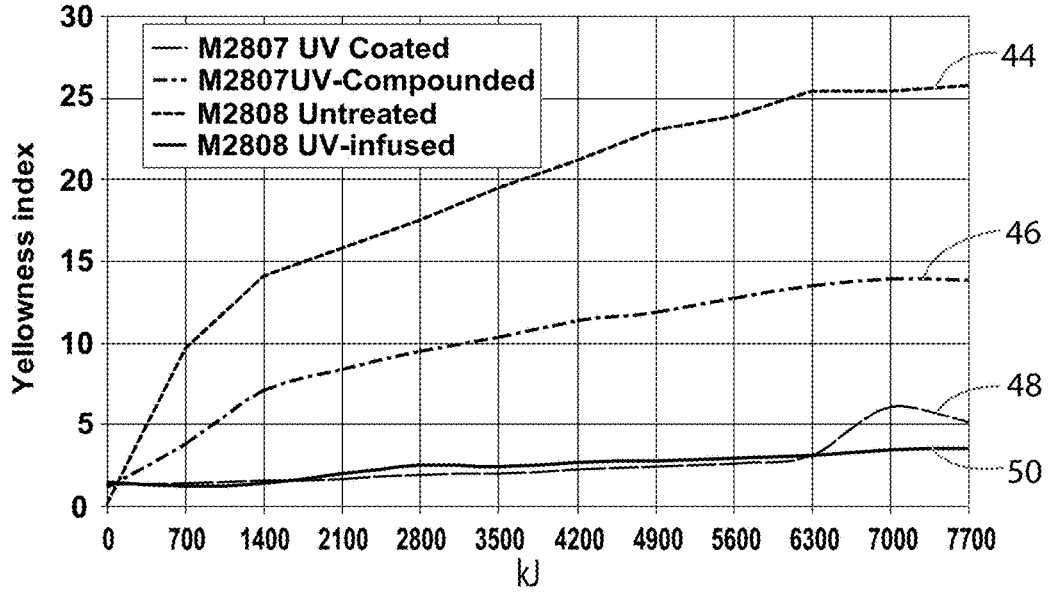
FIG. 5 is a graph showing the yellowness index for several specimens treated with various polymer treatments.
Figure 6:
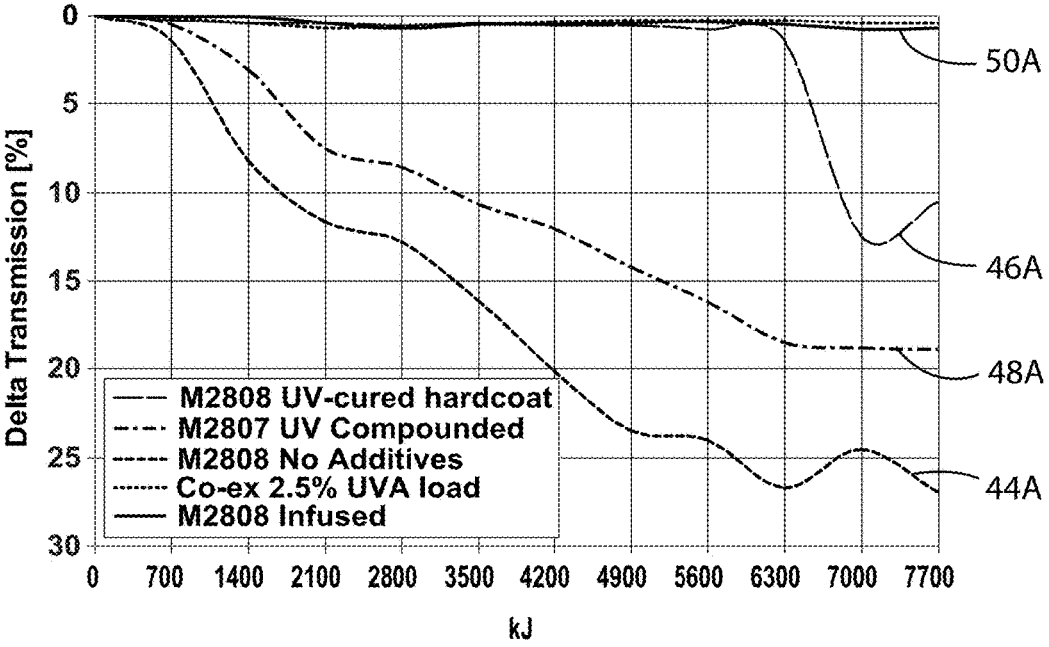
FIG. 6 is a graph showing total light transmission for polymer specimens treated with UV light stabilizers and/or dye.

With further reference to FIG. 5, the yellowness index (calculated according to ASTM E313) for four different types of coated or compounded polymer samples or specimens is shown, and FIG. 6 shows the % change (loss) in total light transmission for several specimens. The specimens comprise inches thick sheets of MAKROLON® polycarbonate. The MAKROLON® polymers utilized for the specimens of FIGS. 5 and 6 are available from Bayer Material Science LLC of Pittsburgh, Pa. Although lens 10 may have a thickness T (FIG. 3) that is significantly greater than the specimens utilized to generate the charts of FIGS. 5 and 6, the yellowness index (FIG. 5) and change in light transmission (FIG. 6) for lenses made from the materials shown in FIGS. 5 and 6 are substantially similar.

The yellowness index for a specimen comprising MAKROLON® M2808 (untreated) is shown by the line 44. As shown in FIG. 5, the yellowness index of the untreated polycarbonate is above 25. In general, this yellowness index level corresponds to polymers having an undesirable yellow tint that is readily visible to the naked eye. Line 46 of FIG. 5 shows the yellowness index for a MAKROLON® M2807 polymer that is coated (i.e. not infused) with a UV light stabilizer. The yellowness index (approximately 13-14) of the UV coated material 46 generally corresponds to a yellow tint that is visible to the naked eye. With further reference to FIG. 6, the M2807 UV coated material has significant light transmission losses as shown by the line 46A.

Referring again to FIG. 5, a M2807 UV-compounded (i.e. mixed) material has a relatively low yellowness index as shown by the line 48. However, with reference to FIG. 6, this material has significant light transmission losses as shown by the line 48A.

Referring again to FIG. 5, a M2808 UV-infused material according to the present invention has a low yellowness index (no more than approximately 3-4) as shown by the line 50 in FIG. 5, and also has a very low light transmission loss (less than about 1%) as shown by the line 50A in FIG. 6. The lines 50 (FIG. 5) and 50A (FIG. 6) correspond to a material having a blue dye and UV light stabilizers infused into a skin or surface portion 38 as shown in FIG. 4, wherein the core or central portion 40 of the material is substantially free of dye and/or UV light stabilizers. Thus, a lens 10 according to the present invention has a very low yellowness index as shown by the line 50 in FIG. 5, and also has very low light transmission loss as shown by the line 50A in FIG. 6.

Figure 7:
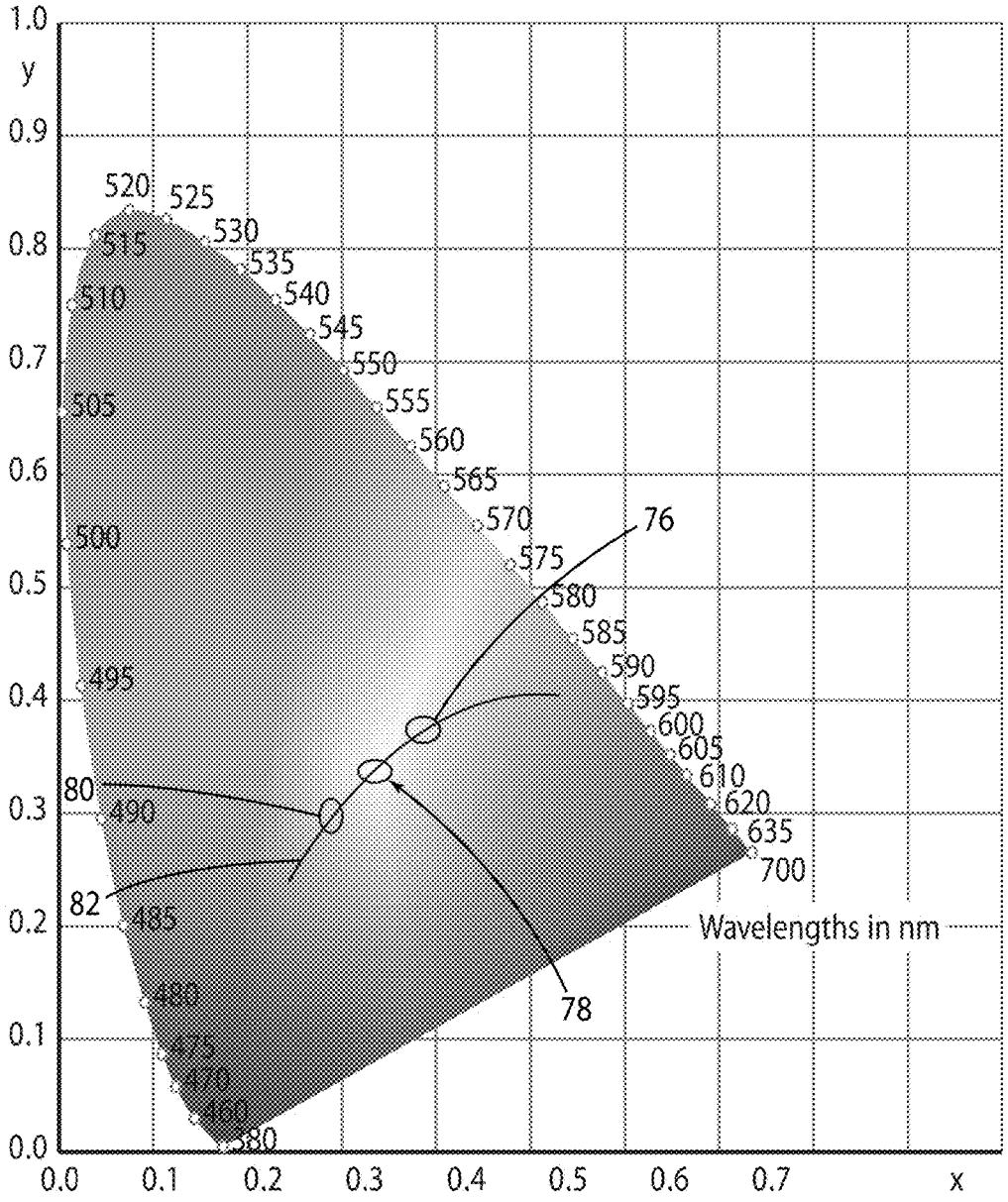
FIG. 7 is a CIE 1931 color spaces map or graph showing the color of a lens before and after infusion with a blue dye.

FIG. 7 is a CIE 1931 color spaces map or graph that relates the response of the human eye to physical pure colors or wavelengths in the electromagnetic visible light spectrum. As known in the art, the Y-axis of the map of FIG. 7 is the brightness or luminosity, and the X-axis is chromaticity. This represents a unitless relationship between how the receptors in the eye respond to various wavelengths of light.

In FIG. 7, the starting color of polymer body 12 is shown by the oval area 76. The color of the blue dye utilized to infuse the polymer body 12 generally falls within the oval 80. Following infusion, the final color of the lens 10 may be substantially white or slightly blue as shown by the oval 78. In general, infusing dye into the polymer body 12 causes the color of the polymer body 12 to shift along the black body (Plankian) radiator curve 82 from the starting color 76 towards the dye color 80. The processing parameters (e.g. dye concentration, immersion time, etc.) may be varied to provide a final color 78 falling on the curve 82 at a desired location between the starting color 76 and the dye color 80.

Referring again to FIG. 2, as discussed above, polymer body 12 of lens 10 may include an outer surface 14 having an input (rear) surface portion 16 and an exit (front) surface portion 20. The outer surface 14 may also include surface portions 52 and 54 extending between surface portions 16 and 20. Outer surface 14 may also include a side/inner surface 56 of a cavity 58. The entire outer surface 14 of polymer body 12 may be infused with dye and UV light stabilizers to thereby form an infused skin or outer portion 38 extending around substantially the entire outer surface 14 of polymer body 12 as shown by the dashed line 42. Alternatively, only certain portions (e.g. front/exit surface portion 20) of surface 14 may be visible when lens 10 is installed in a vehicle. Accordingly, only the visible portions of surface 14 may be infused with dye and/or UV light stabilizers. For example, the entire outer surface 14 may be infused with dye and UV light stabilizers with the exception of the input surface portions 16. This configuration permits light from LED light source 18 to enter into the input surface portion 16 without encountering interference that could otherwise be caused by dye infused into the input surface 16. According to another aspect of the present invention, only the exit (front) surface 20 may be infused with dye and UV light stabilizers, such that the skin or outer portion 38 only extends along the exit surface 20. Blue dye is preferably utilized, such that dye-infused skin or outer portion 38 provides a clear or slightly blue appearance. Also, the dye and UV stabilizers provide a wear resistant surface portion 38 that is chemically bonded/infused into the polymer body 12.

Figure 8:
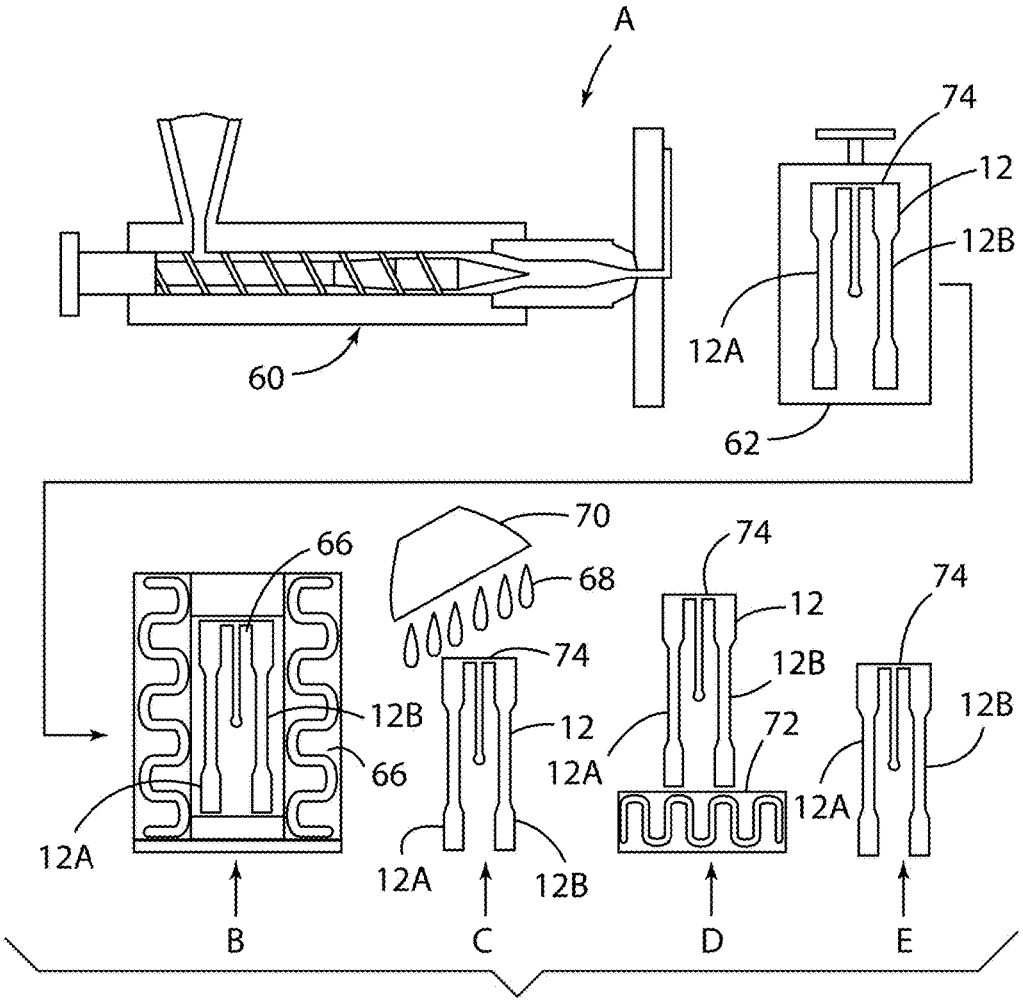
FIG. 8 is a schematic drawing of a process for fabricating a lens according to one aspect of the present invention.

With further reference to FIG. 8, lens 10 is fabricated in a process including steps A-E. First, in step A the polymer body 12 is molded utilizing an injection molding machine 60 and mold 62. One or more polymer bodies 12A, 12B etc. may be temporarily interconnected by a polymer branch structure 74 during the molding process. In step B, the polymer body 12 is then submerged in a heated liquid solution 64 that is disposed within a heated container 66 to thereby infuse the dye and UV stabilizer into the polymer body 12. Alternatively, at least a portion of the polymer body 12 may be brought into contact with liquid solution 64 utilizing a spray applicator (not shown), a "curtain" application, a flow coating process, or a spin application process. A single bath (solution 64/container 66) may be utilized in step B. Solution 64 comprises a dye and water, and may optionally include additional ingredients. The dye comprises a water soluble dye of a known type, and the dye concentration of the dye is from about 0.001% to about 15% by weight, typically 0.01% to 0.5% by weight. The solution 64 is typically about 99.99% to about 85% water by weight. Alternatively, step B may comprise 2 separate stages. In the first stage, the polymer body 12 is placed in a heated solution containing a mostly aqueous dispersion of dyes and/or colorants. The polymer body 12 remains in the heated solution until the desired level of coloring/tinting is achieved. In general, longer immersion times result in a greater concentration of dye in outer skin portion 38 (FIG. 4) and/or a greater penetration depth "D." Thus, if a blue dye is utilized, a relatively short immersion time (e.g. about 30 seconds to about 3 minutes) can be utilized to produce a lens body 12 having a substantially clear appearance or blue appearance. Longer immersion times can be utilized to produce a lens body 12 having a more distinct blue appearance. The optimum contact time of the polymer body 12 with the liquid solution 64 may depend somewhat on the specific material utilized to mold polymer body 12, the temperature of the liquid solution 64, and the amount of dye to be infused. In some cases, the contact time could be less than 1 second, or as long as 20 minutes or more.

The temperature of the solution 64 during contact with polymer body 12 is typically at least room temperature (e.g. 25° C.) and less than the boiling point or decomposition temperature of the solution 64 and/or the polymer body 12 being infused. Typically the solution 64 is between about 25° to about 99° C. In general, the hotter the temperature of the solution 64 and/or the polymer body 12, the faster infusion occurs.

To enhance the ability for the polymer body 12 to absorb a dye, a surfactant (or emulsifier) can be added to the solution 64. Suitable surfactants include for example, anionic surfactants, amphoteric surfactants, and non-ionic surfactants, unsaturated fatty acids, polyphenols and polyalkyl substituted phenols. Combinations of surfactants can also be included in solution 64. Depending on the dye, amphoteric surfactants such as lauryl sulfobetaine and/or dihydroxy ethylakyl betaine can also be included in solution 64.

Solution 64 may further optionally include a performance enhancing additive selected from at least one of UV stabilizers, optical brighteners, antistatic agents, thermal stabilizers, IR absorbers and antimicrobial agents (substances or compounds). In general, performance enhancing additives do not effect coloration of the polymer body 12.

As discussed above, some portions of surface 14 of polymer body 12 such as exit surface portion 20 may be infused with dye, and other portions of surface 14 such as input surface portion 16 may not be infused with dye. This can be accomplished by covering input surface portion 16 with masking tape or other suitable water tight cover prior to immersion of polymer body 12 in solution 64. A temporary coating may also be used to prevent infusion of dye and/or other substances in selected portions of surface 14.

The solution 64 and infusion process may be substantially the same as the methods/processes disclosed in U.S. Pat. No. 7,504,054, issued on Mar. 17, 2009, U.S. Pat. No. 6,994,735, issued on Feb. 7, 2006; U.S. Pat. No. 7,175,675, issued on Feb. 13, 2007; U.S. Pat. No. 6,733,543, issued on May 11, 2004. The entire contents of each of these patent applications are incorporated herein by reference. It will be understood that more than one dye and UV stabilizer may be infused into the polymer body 12, and the terms "a dye," "a UV stabilizer" and similar terms, as used herein, mean "at least one dye" and "at least one UV stabilizer" unless expressly stated otherwise.

Referring again to FIG. 8, in step C the polymer bodies 12 of lenses 10 are then rinsed utilizing water 68 supplied by a water source or nozzle 70. In step D, the polymer bodies 12 are then dried utilizing a heater 72 or other suitable device or process. In step E, the branch structure 74 may be cut, broken, or otherwise removed to separate the individual polymer bodies 12A and 12B. The individual lenses 10 may then be positioned inside a housing 24 (FIG. 3) with LED light source 18 to thereby form a headlamp assembly 5.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A method of forming a color infused optical headlight projector lens, the method comprising:

providing a polymer headlamp lens comprising a substantially transparent polymer lens material having a yellow tint that is visible to the naked eye, wherein the lens has an outer surface including an input surface portion that is configured to receive light from an LED light source, and an exit surface portion opposite the input surface portion, wherein the lens is configured to distribute light from an LED light source whereby the light from the LED source exits the exit surface portion to form a collimated light pattern such that the lens is suitable for use in a vehicle headlight assembly;

covering the input surface portion with a water tight cover that does not cover the exit surface portion; and infusing blue dye into the polymer lens material forming the exit surface portion of the outer surface of the headlamp lens by submerging the covered lens in a liquid solution comprising water and water soluble dye to form an outer layer of the polymer lens material having dye disposed in the polymer lens material outer layer and a core portion of the polymer lens material that is substantially free of dye, and wherein the dye alters the appearance of at least a portion of the exit surface portion such that at least a portion of the exit surface portion has a clear or blue appearance, and wherein the dye is not infused into the input surface portion.

2. The method of claim 1, wherein:

the headlamp lens includes a cavity on a rear side of the headlamp lens, and wherein the input surface portion is disposed in the cavity.

3. The method of claim 1, wherein:

the headlamp lens is molded to provide an integral one-piece construction.

4. The method of claim 3, wherein:

the polymer lens material has substantially uniform optical properties throughout the lens prior to infusing a dye into the outer surface of the headlamp lens.

5. The method of claim 1, wherein:

the dye is infused into the polymer lens material to a maximum depth of about 6-10 microns.

6. The method of claim 1, wherein:

the exit surface of the headlamp lens comprises a front surface.

7. The method of claim 1, including:

infusing a UV stabilizer into at least a portion of the outer surface of the headlamp lens.

8. The method of claim 1, including:

providing a case having a light-transmitting portion;

positioning the headlamp lens inside the case with the exit surface in alignment with the light-transmitting portion such that light exiting the exit surface travels through the light-transmitting portion; and mounting an LED light source adjacent the input surface inside the case such that light from the LED light source is transmitted into the headlamp lens through the input surface.

9. A method of forming a headlamp assembly comprising:

molding a one-piece lens having a beam-shaping front surface and a rear cavity surface from a clear polymer material;

infusing a water soluble blue dye into the front surface of the lens to a maximum depth of 6-10 microns while the cavity surface is covered by a water tight cover; and positioning the lens and an LED inside a housing having a clear side wall.

10. The method of claim 9, including:

positioning the LED adjacent the rear cavity surface; and aligning the beam-shaping front surface with the clear side wall such that light exiting the lens travels through the clear side wall.

11. The method of claim 10, including:

mounting the housing to a front portion of a motor vehicle.

12. The method of claim 1, wherein:

the lens, prior to infusion of at least one dye, has a yellowness index of at least about 10 calculated according to ASTM E313.

13. The method of claim 1, wherein:

blue dye is infused into only the exit surface portion of the outer surface of the headlamp lens.

* * * * *